US012623266B2

(12) United States Patent
Liu et al.

(10) Patent No.: US 12,623,266 B2
(45) Date of Patent: May 12, 2026

(54) THREE-ROLLER DEVICE FOR HIGH-ACCURACY WALL REDUCTION AND UNIFORMATION

(71) Applicant: Hangon Precise Rolling Co., Ltd., Suzhou (CN)

(72) Inventors: Dong Liu, Suzhou (CN); Jianguo Wang, Suzhou (CN)

(73) Assignee: HANGON PRECISE ROLLING CO., LTD., Suzhou (CN)

( * ) Notice: Subject to any disclaimer, the term of this patent is extended or adjusted under 35 U.S.C. 154(b) by 273 days.

(21) Appl. No.: 18/444,752

(22) Filed: Feb. 18, 2024

(65) Prior Publication Data

US 2024/0278301 A1 Aug. 22, 2024

(30) Foreign Application Priority Data

Feb. 20, 2023 (CN) ..... 202310135721.2

(51) Int. Cl.
*B21B 13/08* (2006.01)

(52) U.S. Cl.
CPC ..... *B21B 13/08* (2013.01)

(58) Field of Classification Search
CPC .. B21B 1/20; B21B 1/42; B21B 13/08; B21B 13/008; B21B 17/02; B21B 17/12; B21B 19/02; B21B 19/04; B21B 27/02; B21B 27/024; B21B 27/025; B21B 27/037
See application file for complete search history.

(56) References Cited

U.S. PATENT DOCUMENTS 361,960 A * 4/1887 Mannesmann ..... B21B 19/04 72/97
2005/0210944 A1* 9/2005 Nakaike ..... B21B 25/00 72/97

* cited by examiner

*Primary Examiner* — Teresa M Ekiert
(74) *Attorney, Agent, or Firm* — MATTHIAS SCHOLL P.C.; Matthias Scholl

(57) ABSTRACT

A device for high-accuracy wall reduction and uniformation includes: three rollers, three guide plates, and a plug. The three rollers are circumferentially evenly distributed along a rolling line which is a straight line of the moving direction of a billet being rolled. The three rollers are of unequal diameter rotating structure and each roller has a small end and a big end; three small ends of the three rollers are located at a first end of the device, and three big ends of the three rollers are located at a second end; and the three rollers are rotatable around their own axis. Each guide plate is disposed between every two adjacent rollers. The three guide plates rotatably abut against the three rollers, and are circumferentially evenly distributed along the rolling line. The plug is disposed in a forming space formed by the three rollers and three guide plates.

15 Claims, 7 Drawing Sheets

THREE-ROLLER DEVICE FOR HIGH-ACCURACY WALL REDUCTION AND UNIFORMATION

CROSS-REFERENCE TO RELATED APPLICATIONS

Pursuant to 35 U.S.C.§ 119 and the Paris Convention Treaty, this application claims foreign priority to Chinese Patent Application No. 202310135721.2 filed Feb. 20, 2023, the contents of which, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, MA 02142.

BACKGROUND

The disclosure relates to a three-roller device for high-accuracy wall reduction and uniformation.

Conventionally, hot rolled seamless steel pipe mill machine is used to manufacture seamless pipes, with the following technical processes: heating a tube blank, perforating, performing wall reduction and extension to obtain a raw tube, and sizing the raw tube. The following disadvantages are associated with the production process:

1) The methods involve many forming processes, multiple types of equipment, long production line, and complex equipment layout. During the production process, errors gradually accumulate in each step, making the final product unable to meet the specification requirements.
2) The seamless steel pipe continuous rolling mill works in a continuous assembly line, which leads to equipment fatigue and wear. The accuracy of the wall thickness of seamless steel pipes is hardly improved, seriously affecting the production of seamless steel pipes with high accuracy requirement.

SUMMARY

To solve the aforesaid problems, the disclosure provides a three-roller device for high-accuracy wall reduction and uniformation comprising:

three rollers, the three rollers being circumferentially evenly distributed along a rolling line which is a straight line of a moving direction of a billet being rolled, wherein the three rollers are of unequal diameter rotating structure and each roller has a small end and a big end; three small ends of the three rollers are located at a first end of the device, and three big ends of the three rollers are located at a second end; and the three rollers are rotatable around their own axis;

three guide plates, each guide plate being disposed between every two adjacent rollers, the three guide plates rotatably abutting against the three rollers, and being circumferentially evenly distributed along the rolling line; and a plug, the plug being disposed in a forming space formed by the three rollers and three guide plates, wherein, the forming space is cylindrical, and an axis of the plug is coincident with the rolling line; the plug is an unequal diameter rotating structure having a small end and a big end; and the small end of the plug is located in an opening of the forming space, and the opening is a feed port of the billet.

In a class of this embodiment, the three rollers are the same in dimensions; and, the small end of the plug is disposed at the first end of the device, or the small end of the plug is disposed at the second end of the device.

In a class of this embodiment, the three rollers comprise two first rollers and one second roller; the two first rollers and the second roller are the same in shape; the two first rollers are the same in dimensions; a diameter of the two first rollers is less than that of the second roller in a plane parallel to the rolling line; and the small ends of the two first rollers and the small end of the second roller are located at the small end of the plug.

In a class of this embodiment, a unit pitch t of a rolled piece of the billet is:

$$T = \pi \cdot \eta 0 \cdot D \cdot tg\beta;$$

β is a feed angle; D is a diameter of the billet; η0 is an axial slip coefficient at an outlet of the device;

along the rolling line, the plug comprises a preparation section, a wall reduction section, a uniform section, and a circular section;

diameters of the preparation section, the wall reduction section, and the uniform section increase sequentially; an axial length of the preparation section is 0.4-0.6 t, an axial length of the uniform section is 2.0-2.5 t, and the axial length of the circular section is 0.9-1.1 t.

In a class of this embodiment, a minimum diameter of the preparation section is $2R_1$, and a diameter at the connection between the preparation section and the wall reduction section is $2R_2$; the wall reduction section comprises a first wall reduction section and a second wall reduction section; the preparation section is connected to the first wall reduction section, and the connection between the first wall reduction section and the second wall reduction section is $2R_3$; the second wall reduction section is connected to the uniform section; a diameter at the connection between the uniform section and the circular section is $2R_4$; a wall reduction amount of the first wall reduction section is ΔS1; a wall reduction amount of the second wall reduction section is ΔS2, and a total wall reduction amount of the wall reduction section is ΔS:

$$\Delta S = \Delta S_1 + \Delta S_2;$$

$$R_3 = \frac{D \cdot (1 - I)}{2} - (S - \Delta S_1);$$

D is a diameter of the billet; S is a wall thickness of the billet; I is a reduction amount of the rolled piece; the reduction amount I of the rolled piece is 17% to 21%, and a front reduction amount W of the plug is 16% to 20%, and $\Delta S_1/\Delta S_2$ is in the range of 0.5 to 2.

In a class of this embodiment, outer walls of the wall reduction section and the circular section are curved surfaces.

In a class of this embodiment, each of the three rollers comprises a first roller body and a second roller body; a big end of the first roller body is connected to a small end of the second roller body to form a roller throat; a ratio of a diameter of the roller throat to a diameter of the billet is between 1 and 3; a ratio of an axial length of the three rollers to the diameter of the roller throat is between 1.5 and 3.5; a ratio of an axial length of the first roller body to an axial length of the second roller body is 3:5; a cone angle of the three rollers is 3.5° to 5°, and a rolling angle of the three rollers is 11° to 13°.

In a class of this embodiment, a joint between the first roller body and the second roller body is chamfered, with a chamfer radius of not less than 500 mm.

The disclosure also provides a method for wall reduction and uniformation using the device, the method comprising rotating the three rollers around their own axis in a revolving speed, feeding the billet from the small end to the big end of the plug into the forming space to contact the three rollers, driving the billet to move forward spirally along the rolling line to further contact the plug for wall reduction and uniformation, and outputting a final product from a gap formed by the three rollers, the three guide plates, and the plug.

In a class of this embodiment, the billet is heated prior to being rolled.

The following advantages are associated with the three-roller device for high-accuracy wall reduction and uniformation of the disclosure.

The three rollers are all active rollers, and each of the three guide plates are disposed between every two adjacent rollers. The plug is located in the forming space enclosed by the three guide plates and the three rollers. The smaller end of the plug is a feeding end, and the billet enters the forming space from the smaller end of the plug. After contacting with the rollers, the billet continues moving forward spirally along the rolling line. Upon in contact with the plug, the billet is rolled through the wall reduction and uniform process under the joint action of the three rollers and the plug. The final product is outputted from the big end of the plug thus completing the rolling of seamless pipes. The three rollers are all active rollers, which promote the forward movement of the billet metal along the rolling line. Meanwhile, the three guide plates are combined with the three rollers to limit the billet in the forming space. The three rollers are combined with the plug to complete the wall reduction and uniformation processes in one step, improving the rolling speed and avoiding the accumulation of forming errors caused by a long rolling process, improving the accuracy and production efficiency of the seamless pipe products.

The billet cooperates with the plug in the forming space enclosed by the three rollers and the three guide plates and is rolled in one step, avoiding error accumulation caused by multiple steps of rolling, and improving the forming efficiency of seamless pipes and improving the rolling accuracy.

Figure 1:
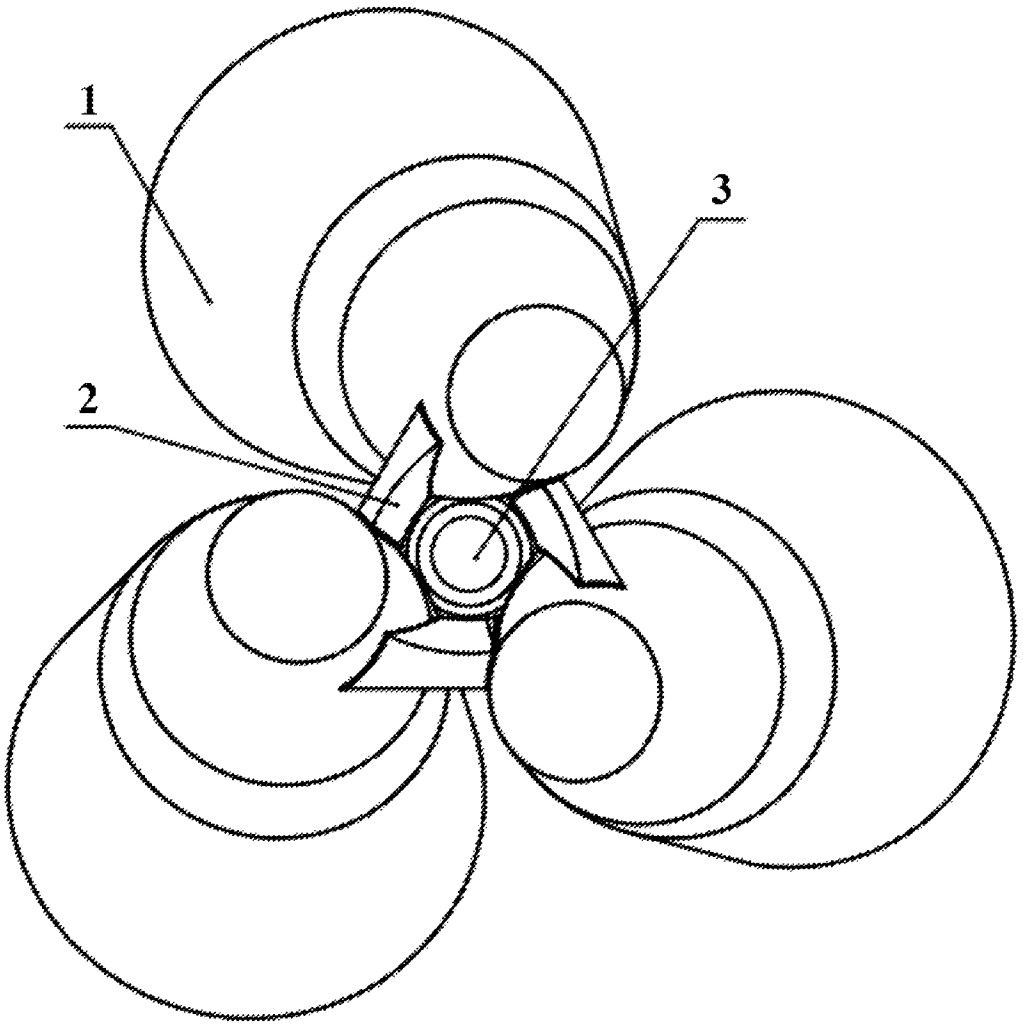
FIG. 1 is a front view of a three-roller device for high-accuracy wall reduction and uniformation in Example 1 of the disclosure.
Figure 2:
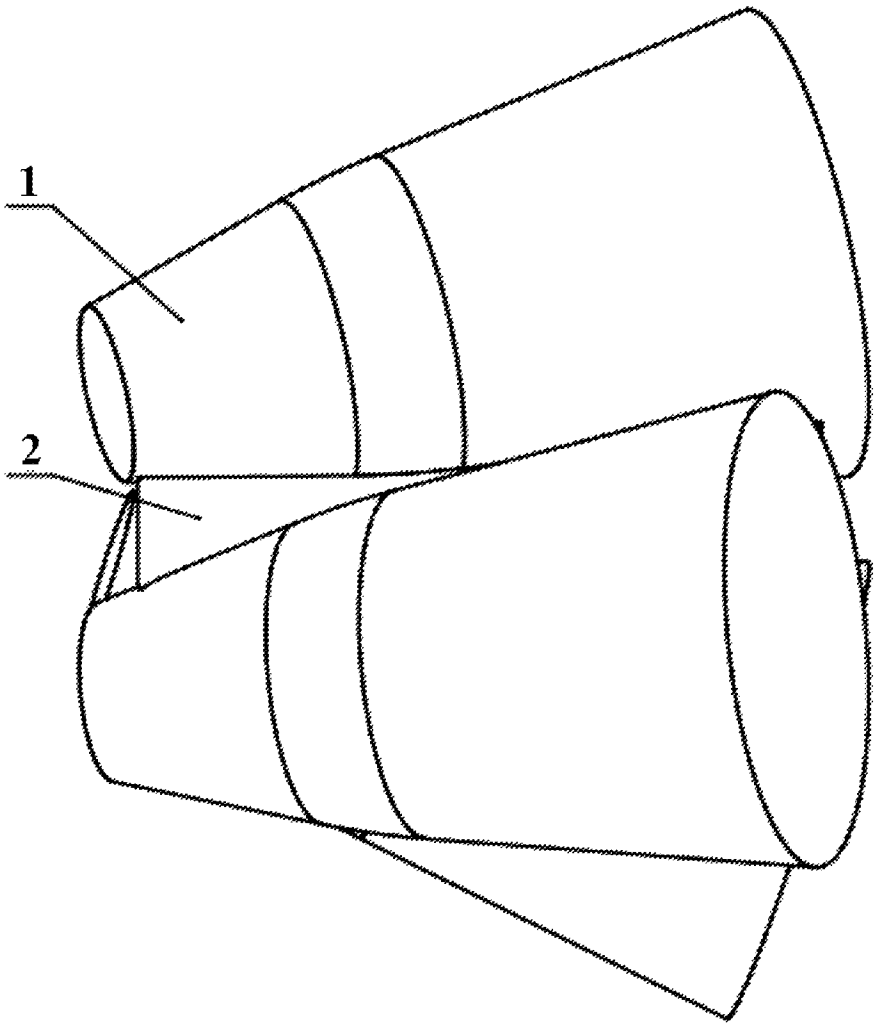
FIG. 2 is a side view of a three-roller device for high-accuracy wall reduction and uniformation in Example 1 of the disclosure.

In the drawings, the following reference numbers are used: 1. Roller; 101. First roller body; 102. Second roller body; 2. Guide plate; 3. Plug; 301. Preparation section; 302. Wall reduction section; 303. Uniform section; 304. Circular section; 4. First roller; 5. Second roller.

DETAILED DESCRIPTION

To further illustrate the disclosure, embodiments detailing a three-roller device for high-accuracy wall reduction and uniformation and use thereof are described below. It should be noted that the following embodiments are intended to describe and not to limit the disclosure.

The disclosure provides a three-roller device for high-accuracy wall reduction and uniformation, comprising three rollers 1, three guide plates 2 and a plug 3. The three rollers 3 are circumferentially evenly distributed along the rolling line which is a straight line of the moving direction of a billet being rolled; the three rollers 1 are of unequal diameter rotating structure and each roller has a small end and a big end; three small ends of the three rollers 1 are located at a first end of the device, and three big ends of the three rollers are located at a second end; and the three rollers are rotatable around their own axis; each guide plate 2 is disposed between every two adjacent rollers 1; the three guide plates 2 rotatably abut against the three rollers 1, and are circumferentially evenly distributed along the rolling line; the plug 2 is disposed in a forming space formed by the three rollers 1 and three guide plates 2; the forming space is cylindrical, and the axis of the plug 3 is coincident with the rolling line; the plug 3 is an unequal diameter rotating structure having a small end and a big end; and the small end of the plug 3 is located in an opening of the forming space, and the opening is a feed port of the billet.

The three rollers 1 are all active rollers, and each of the three guide plates 2 are disposed between every two adjacent rollers 1. The plug 3 is located in the forming space enclosed by the three guide plates 2 and the three rollers 1. The smaller end of the plug 3 is a feeding end, and the billet enters the forming space from the smaller end of the plug 3. After contacting with the rollers 1, the billet continues moving forward spirally along the rolling line. Upon in contact with the plug 3, the billet is rolled through the wall reduction and uniform process under the joint action of the three rollers 1 and the plug 3. The final product is outputted from the big end of the plug 3 thus completing the rolling of seamless pipes. The three rollers 1 are all active rollers, which promote the forward movement of the billet metal along the rolling line. Meanwhile, the three guide plates 2 are combined with the three rollers 1 to limit the billet in the forming space. The three rollers 1 are combined with the plug 3 to complete the wall reduction and uniformation processes in one step, improving the rolling speed and avoiding the accumulation of forming errors caused by a long rolling process, improving the accuracy and production efficiency of the seamless pipe products. Optionally, both the three guide plates 2 and the plug 3 can be connected to other components of the rolling device as needed so as to avoid misalignment that negatively affects the normal production of the seamless pipes during the rolling process.

The disclosure also provides a method for wall reduction and uniformation using the device, the method comprising rotating the three rollers 1 around their own axis in a revolving speed, feeding the billet from the small end to the big end of the plug into the forming space to contact the three rollers 1, driving the billet to move forward spirally along the rolling line to further contact the plug 3 for wall reduction and uniformation, and outputting a final product from a gap formed by the three rollers 1, the three guide plates 2, and the plug 3. The billet cooperates with the plug 3 in the forming space enclosed by the three rollers 1 and the three guide plates 2 and is rolled in one step, avoiding error accumulation caused by multiple steps of rolling, and improving the forming efficiency of seamless pipes and improving the rolling accuracy.

In actual production, the billet is heated before being rolled, to ensure smooth processing of the billet.

The following is detailed illustrations of the three-roller device for high-accuracy wall reduction and uniformation and use thereof of the disclosure through some examples.

Example 1

In this example, the dimensions of the three rollers 1 are the same, and the smaller end of the plug 3 is located at the three small ends of the three rollers 1. The small end of the plug 3 is the feeding end, that is, the small end of the plug is located in the opening of the forming space, and the opening is a feed port of the billet, as shown in FIG. 1.

Figure 3:
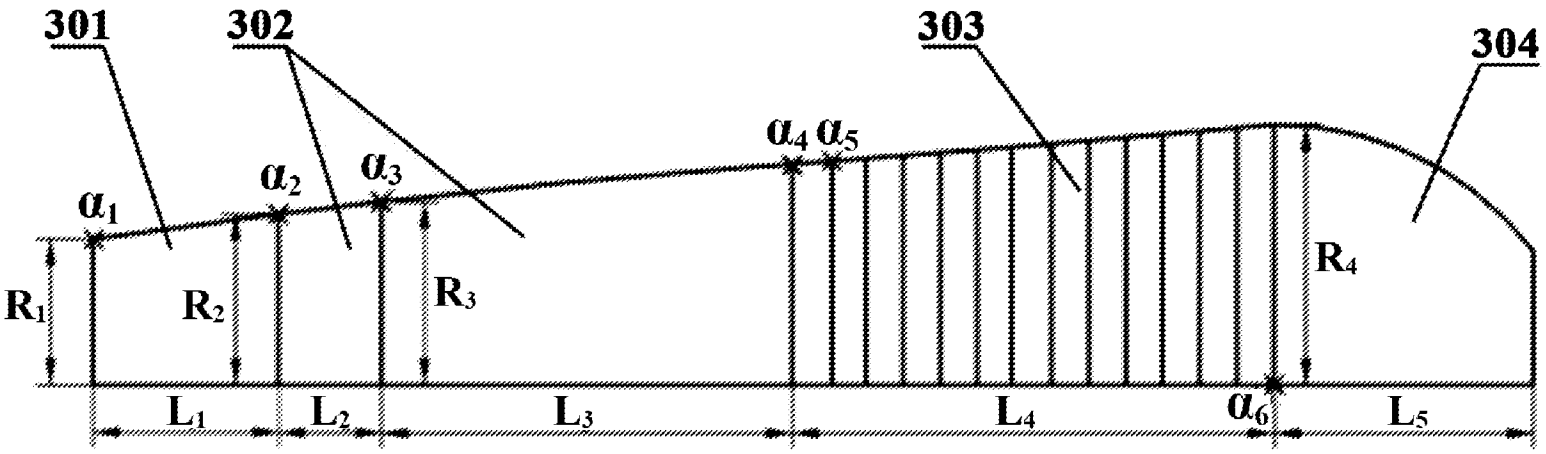
FIG. 3 is a sectional view of a plug of a three-roller device for high-accuracy wall reduction and uniformation in one embodiment of the disclosure.

The unit pitch t of a rolled piece of the billet is:

$$T = \pi \cdot \eta_0 \cdot D \cdot tg\beta;$$

β is a feed angle; D is a diameter of the billet; $\eta_0$ is an axial slip coefficient at an outlet of the device;

Specifically, along the rolling line, as shown in FIG. 3, the plug 3 comprises a preparation section 301, a wall reduction section 302, a uniform section 303, and a circular section 304; the diameters of the preparation section 301, the wall reduction section 302, and the uniform section 303 increase sequentially; the axial length of the preparation section 301 is 0.4-0.6 t, the axial length of the uniform section 303 is 2.0-2.5 t, and the axial length of the circular section 304 is 0.9-1.1 t.

The minimum diameter of the preparation section 301 is $2R_1$, and a diameter at the connection between the preparation section 301 and the wall reduction section 302 is $2R_2$; the wall reduction section 302 comprises a first wall reduction section and a second wall reduction section; the preparation section 301 is connected to the first wall reduction section 302, and the connection between the first wall reduction section and the second wall reduction section is $2R_3$; the second wall reduction section 302 is connected to the uniform section 303; the diameter at the connection between the uniform section 303 and the circular section 304 is $2R_4$.

Furthermore, the plug 3 is axially sectioned, and the intersection of the connection surface of the uniform section 303 and the circular section 304 with the axis of the plug 3 is $a_6$. At the point $a_6$, the inner diameter of the target seamless tube is $2R_4$. Draw a first concentric circle at the center of the circle, and the intersection of the first concentric circle and the outer contour of the axial cross-section of the uniform section 303 is $a_4$. The diameter of the first concentric circle is $$\varphi 1 = D - 2S;$$

where, D is the diameter of the billet;

S is the wall thickness of the billet.

Along the direction opposite to the feed direction of the billet, at every 10 mm interval, a radial section of the uniform section 303 of the plug 3 perpendicular to the rolling line is designed, and the radial section is circular; the circular radial section is tangent to the rollers, forming a second concentric circle. The intersection point of the second concentric circle and the outer contour line of the axial section of the uniform section 303 is a5, and the diameter of the second concentric circle is:

$$\varphi 2 = \varphi - 2S;$$

S is the wall thickness of the billet; φ is the diameter of the tangent circle formed by the axial section of the top head and the rolls.

By analogy, a plurality of radial cross-section circles with an interval of 10 mm are designed for the uniform section 303 until reaching the connection between the uniform section 303 and the wall reduction section 302. The outer walls of the uniform section 303 are in smooth connection, connecting the contour lines of the cross-section circles. Thus, through scanning of each cross-section circle along the axis of the plug 3, the uniform section 303 is formed.

The wall reduction amount of the first wall reduction section is ΔS1; the wall reduction amount of the second wall reduction section is ΔS2, and the total wall reduction amount of the wall reduction section is ΔS:

$$\Delta S = \Delta S_1 + \Delta S_2;$$

$$R_3 = \frac{D \cdot (1 - I)}{2} - (S - \Delta S_1);$$

D is a diameter of the billet; S is a wall thickness of the billet; I is a reduction amount of the rolled piece of the billet; the reduction amount I of the rolled piece is 17% to 21%, and a front reduction amount W of the plug is 16% to 20%, and $\Delta S_1/\Delta S_2$ is in the range of 0.5 to 2.

The outer walls of the wall reduction section 302 and the circular section 304 are curved surfaces.

After the dimension R3 of the junction of the first wall reduction section 302 and the second wall reduction section 302 is determined, the intersection of the outer walls of the axial sections of the first wall reduction section 302 and the second wall reduction section 302 is determined as a3, and the contour line of the outer wall of the axial section of the second wall reduction section 302 is an arc passing through the point a3 and the point a4, and the distance between the projections of the point a3 and the point a4 on the axis of the plug 3 is an axial length L3 of the second wall reduction section 302, and the arc is tangent to the line defined by points a4 and a5.

Upon determining the contour line of the outer wall of the axial cross-section of the first wall reduction section 302, take the rolling line as the axis, define a cylinder with dimensions D×W, and determine the position where the cylinder is just in contact with the rollers 1, and thus the axial length L2 of the first wall reduction section 302 is determined; extend the arc passing through the point a3 and the point a4, and determine the intersection a2 of the contour line of the outer wall of the axial cross-section of the first wall reduction section 302 and the preparation section 301.

The plug 3 adopts a four segment design, with a significantly extended uniform section 303, thus improving the dimensional accuracy of the finished product.

Figure 4:
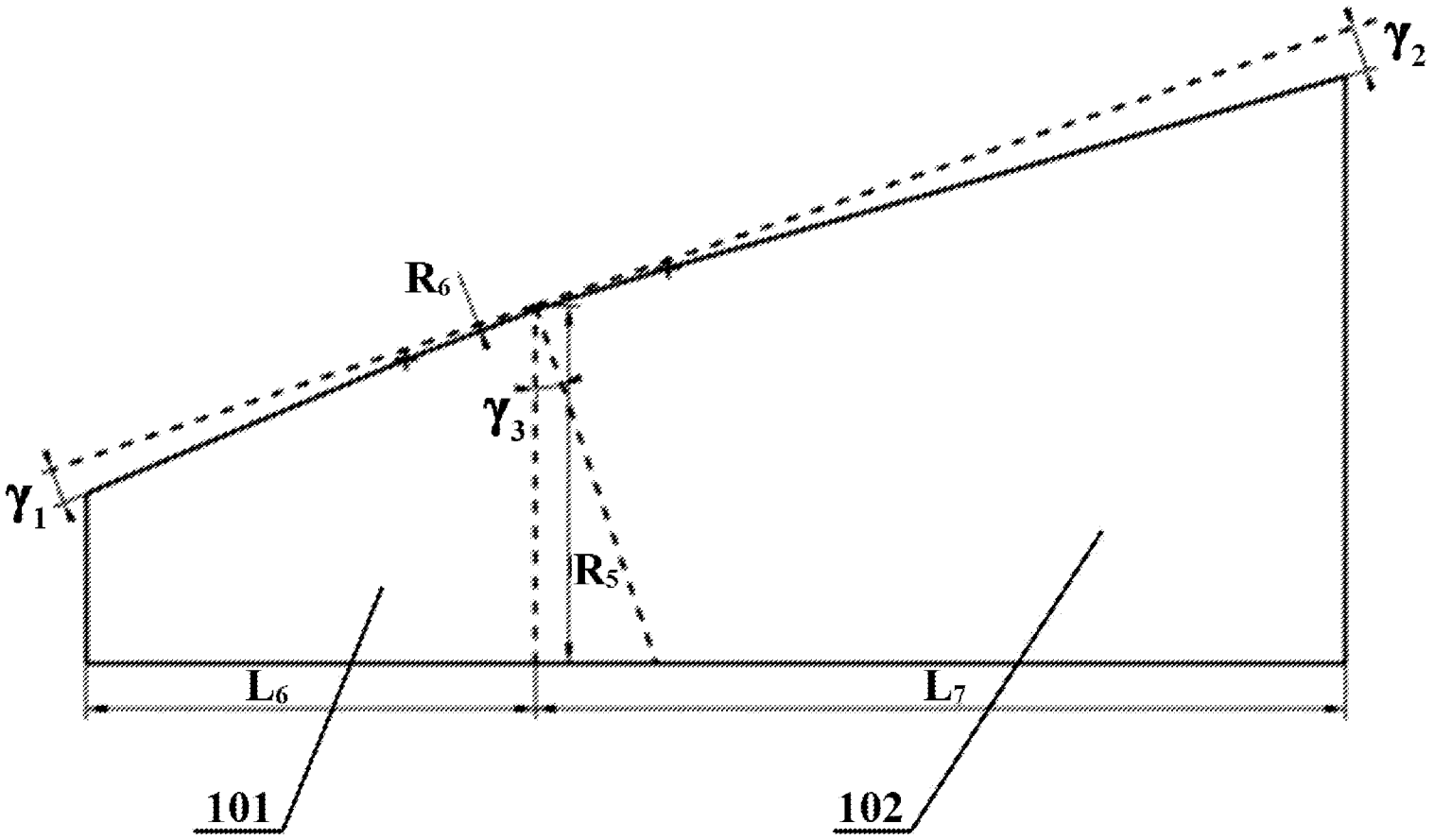
FIG. 4 is a sectional view of a roller of a three-roller device for high-accuracy wall reduction and uniformation in one embodiment of the disclosure.

Specifically, as shown in FIG. 4, each of the three rollers comprises a first roller body 101 and a second roller body 102; a big end of the first roller body 101 is connected to a small end of the second roller body 102 to form a roller throat; a ratio of a diameter of the roller throat to a diameter of the billet is between 1 and 3; a ratio of an axial length of the three rollers to the diameter of the roller throat is between 1.5 and 3.5; a ratio of an axial length of the first roller body 101 to an axial length of the second roller body 102 is 3:5; a cone angle of the three rollers is 3.5° to 5° (the cone angle $\gamma_1$ of the first roller body 101 and the cone angle $\gamma_2$ of the second roller body 102), and a rolling angle of the three rollers 1 is 11° to 13°.

In practical applications, the parameters of the roller 1 can be selected based on specific working conditions and forming requirements.

The joint between the first roller body and the second roller body is chamfered, with a chamfer radius of not less than 500 mm, which is conducive to improving the forming accuracy of seamless pipes.

Example 2

Figure 5:
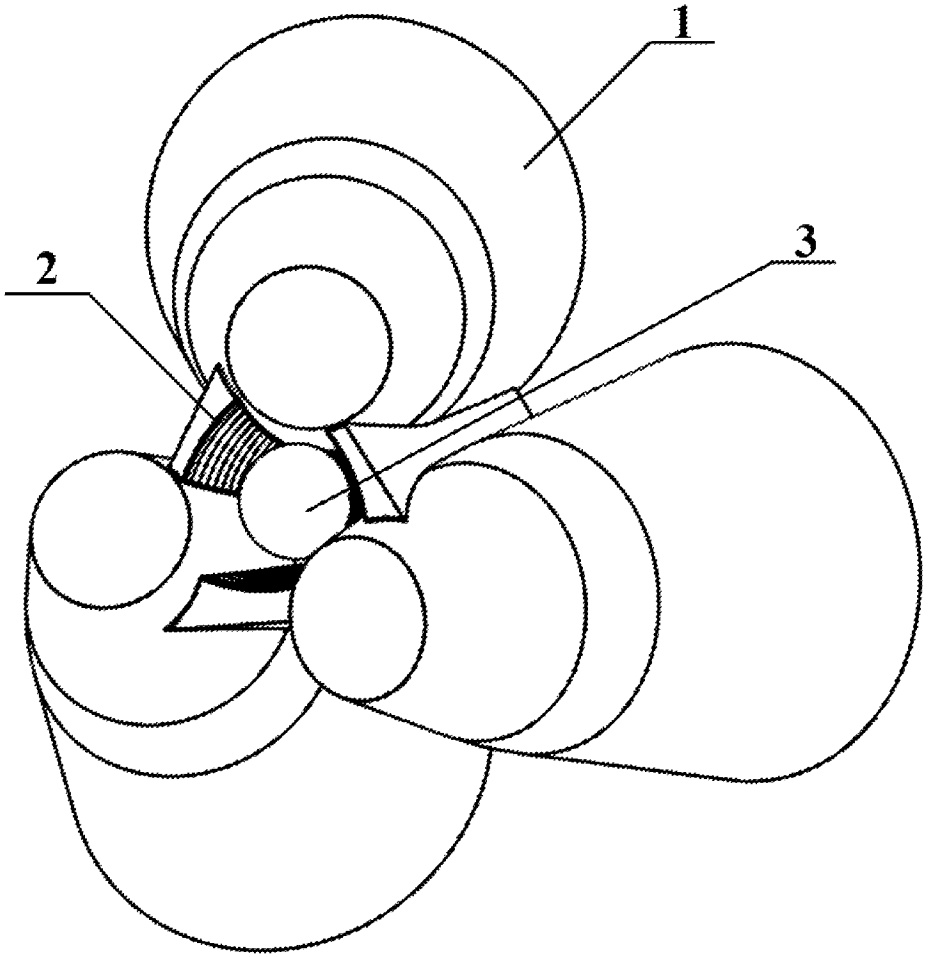
FIG. 5 is a side view of a three-roller device for high-accuracy wall reduction and uniformation in Example 2 of the disclosure.

In this example, the three rollers 1 are the same in dimensions; the small end of the plug 3 is disposed at the first end of the device. The small end of the plug 3 is located in the opening of the forming space formed by the big ends of three rollers and three guide plates, and the opening is the feed port of the billet, as shown in FIG. 5. When the small end of the plug 3 is disposed at the first end (big end) of the device, the defects of the uneven axial deformation of the finished product is solved and the dimensional accuracy of the finished product is improved.

In practical applications, the arrangement direction of the plug 3 can also be selected based on specific working conditions and the specifications of seamless pipes and billets, to improve the flexibility and adaptability of the device of the disclosure. The structure of the plug 3 and the rollers 1 is the same as that in Example 1.

Example 3

Figure 6:
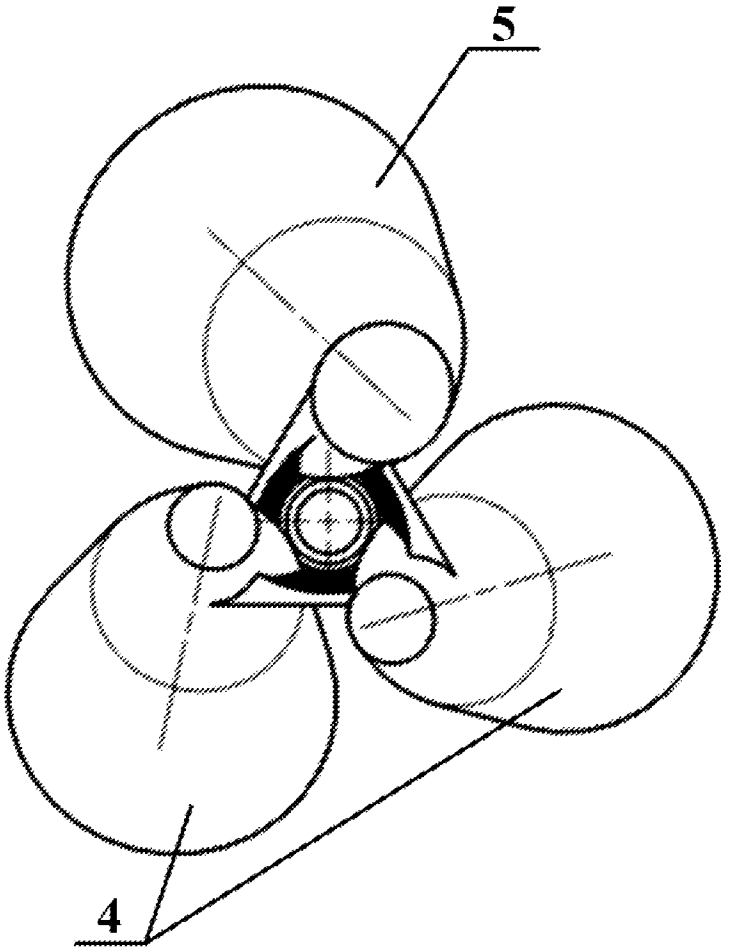
FIG. 6 is a front view of a three-roller device for high-accuracy wall reduction and uniformation in Example 3 of the disclosure.
Figure 7:
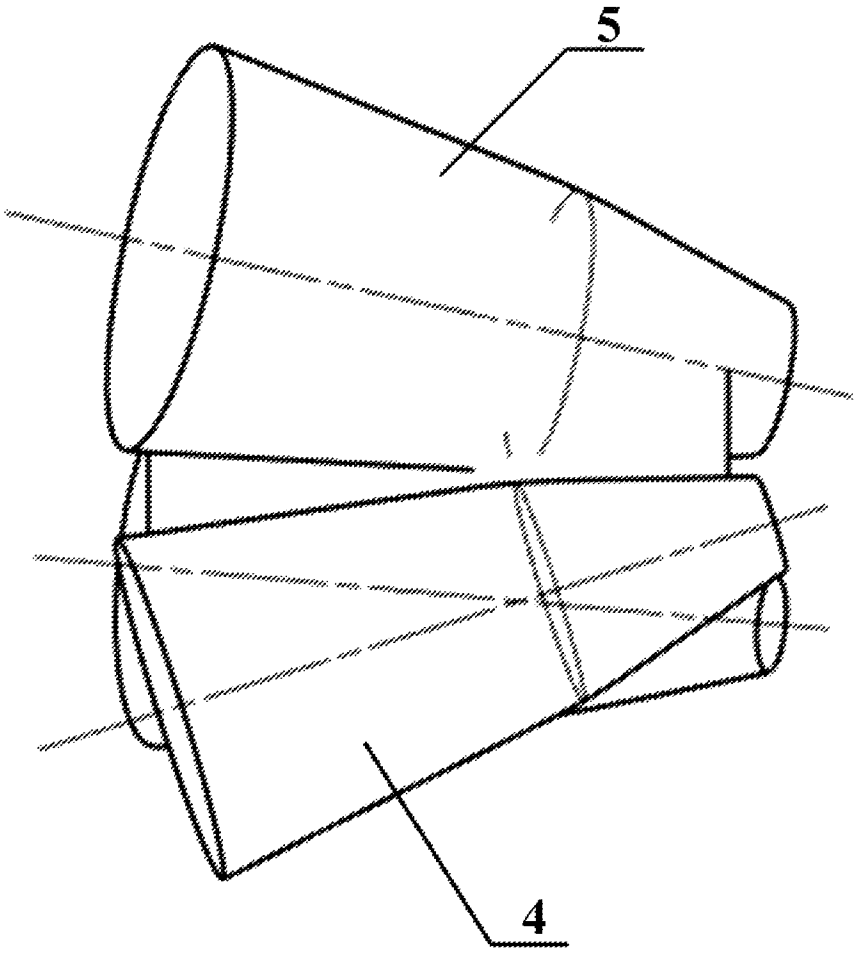
FIG. 7 is a front view of a three-roller device for high-accuracy wall reduction and uniformation in Example 3 of the disclosure.

In this example, the three rollers 1 are different in dimensions. The three rollers comprise two first rollers 4 and one second roller 5; the two first rollers 4 and the second roller 5 are the same in shape; the two first rollers 4 are the same in dimensions; the diameter of the two first rollers is less than that of the second roller in the plane parallel to the rolling line. That is, two small rollers 1 and one large roller 1 are provided, as shown in FIGS. 6 and 7. The small ends of the two first rollers 4 and the small end of the second roller 5 are located at the small end of the plug. That is, the opening formed by the small ends of the three rollers 1 and the three guide plates 2 is the feed port of the forming space. The design scheme of one large-sized roller 1 and two small-sized rollers with the same shape can increase the shear deformation of the finished product, refine the grain size, and improve the microstructure and properties.

The structure of the plug 3 is the same as that in Example 1.

The three rollers 1 are all active rollers, and each of the three guide plates 2 are disposed between every two adjacent rollers 1. The plug 3 is located in the forming space enclosed by the three guide plates 2 and the three rollers 1. The smaller end of the plug 3 is a feeding end, and the billet enters the forming space from the smaller end of the plug 3. After contacting with the rollers 1, the billet continues moving forward spirally along the rolling line. Upon in contact with the plug 3, the billet is one-step rolled through the wall reduction and uniform process under the joint action of the three rollers 1 and the plug 3, reducing the error accumulation and improving rolling efficiency.

Terminology:

Feed angle: an angle between the horizontal projection of the axis of a roller and the rolling line on a horizontal section passing through the rolling line.

Rolling angle: an angle between the vertical projection of the axis of a roller and the rolling line on a vertical section passing through the rolling line.

Cone angle: an angle between the generatrix of a roller and the rolling line on a section passing through the axis of the roller.

Rolling line: a centerline surrounded by three rollers.

It will be obvious to those skilled in the art that changes and modifications may be made, and therefore, the aim in the appended claims is to cover all such changes and modifications.

The invention claimed is:

1. A device, comprising:

three rollers, the three rollers being circumferentially evenly distributed along a rolling line which is a straight line of a moving direction of a billet being rolled, wherein the three rollers are of unequal diameter rotating structure and each roller has a small end and a big end; three small ends of the three rollers are located at a first end of the device, and three big ends of the three rollers are located at a second end; and the three rollers are rotatable around their own axis;

three guide plates, each guide plate being disposed between every two adjacent rollers, the three guide plates rotatably abutting against the three rollers, and being circumferentially evenly distributed along the rolling line;

a plug, the plug being disposed in a forming space formed by the three rollers and three guide plates, wherein, the forming space is cylindrical, and an axis of the plug is coincident with the rolling line; the plug is an unequal diameter rotating structure having a small end and a big end; and the small end of the plug is located in an opening of the forming space, and the opening is a feed port of the billet; and the three rollers comprise two first rollers and one second roller; the two first rollers and the second roller are the same in shape; the two first rollers are the same in dimensions; a diameter of the two first rollers is less than that of the second roller in a plane parallel to the rolling line; and the small ends of the two first rollers and the small end of the second roller are located at the small end of the plug.

2. The device of claim 1, wherein the three rollers are the same in dimensions; and, the small end of the plug is disposed at the first end of the device, or the small end of the plug is disposed at the second end of the device.

3. A method for wall reduction and uniformation using the device of claim 1, the method comprising rotating the three rollers around their own axis in a revolving speed, feeding the billet from the small end to the big end of the plug into the forming space to contact the three rollers, driving the billet to move forward spirally along the rolling line to further contact the plug for wall reduction and uniformation, and outputting a final product from a gap formed by the three rollers, the three guide plates, and the plug.

4. The method of claim 3, further comprising heating the billet prior to being rolled.

5. A device, comprising:

three rollers, the three rollers being circumferentially evenly distributed along a rolling line which is a straight line of a moving direction of a billet being rolled, wherein the three rollers are of unequal diameter rotating structure and each roller has a small end and a big end; three small ends of the three rollers are located at a first end of the device, and three big ends of the three rollers are located at a second end; and the three rollers are rotatable around their own axis;

three guide plates, each guide plate being disposed between every two adjacent rollers, the three guide plates rotatably abutting against the three rollers, and being circumferentially evenly distributed along the rolling line;

a plug, the plug being disposed in a forming space formed by the three rollers and three guide plates, wherein, the forming space is cylindrical, and an axis of the plug is coincident with the rolling line; the plug is an unequal diameter rotating structure having a small end and a big end; and the small end of the plug is located in an opening of the forming space, and the opening is a feed port of the billet; and a unit pitch t of a rolled piece of the billet is:

$$T = \pi \cdot \eta_0 \cdot D \cdot tg\beta;$$

wherein:

β is a feed angle; D is a diameter of the billet; $\eta_0$ is an axial slip coefficient at an outlet of the device;

along the rolling line, the plug comprises a preparation section, a wall reduction section, a uniform section, and a circular section;

diameters of the preparation section, the wall reduction section, and the uniform section increase sequentially; an axial length of the preparation section is 0.4-0.6 t, an axial length of the uniform section is 2.0-2.5 t, and the axial length of the circular section is 0.9-1.1 t.

6. The device of claim 5, wherein a minimum diameter of the preparation section is $2R_1$, and a diameter at the connection between the preparation section and the wall reduction section is $2R_2$; the wall reduction section comprises a first wall reduction section and a second wall reduction section; the preparation section is connected to the first wall reduction section, and a connection between the first wall reduction section and the second wall reduction section is $2R_3$; the second wall reduction section is connected to the uniform section; a diameter at the connection between the uniform section and the circular section is $2R_4$; a wall reduction amount of the first wall reduction section is ΔS1; a wall reduction amount of the second wall reduction section is ΔS2, and a total wall reduction amount of the wall reduction section is ΔS:

$$\Delta S = \Delta S_1 + \Delta S_2;$$

$$R_3 = \frac{D \cdot (1 - I)}{2} - (S - \Delta S_1);$$

D is a diameter of the billet; S is a wall thickness of the billet; I is a reduction amount of the rolled piece; the reduction amount I of the rolled piece is 17% to 21%, and a front reduction amount W of the plug is 16% to 20%, and $\Delta S_1/\Delta S_2$ is in the range of 0.5 to 2.

7. The device of claim 6, wherein outer walls of the wall reduction section and the circular section are curved surfaces.

8. The device of claim 5, wherein the three rollers are the same in dimensions; and, the small end of the plug is disposed at the first end of the device, or the small end of the plug is disposed at the second end of the device.

9. A method for wall reduction and uniformation using the device of claim 5, the method comprising rotating the three rollers around their own axis in a revolving speed, feeding the billet from the small end to the big end of the plug into the forming space to contact the three rollers, driving the billet to move forward spirally along the rolling line to further contact the plug for wall reduction and uniformation, and outputting a final product from a gap formed by the three rollers, the three guide plates, and the plug.

10. The method of claim 9, further comprising heating the billet prior to being rolled.

11. A device, comprising:

three rollers, the three rollers being circumferentially evenly distributed along a rolling line which is a straight line of a moving direction of a billet being rolled, wherein the three rollers are of unequal diameter rotating structure and each roller has a small end and a big end; three small ends of the three rollers are located at a first end of the device, and three big ends of the three rollers are located at a second end; and the three rollers are rotatable around their own axis;

three guide plates, each guide plate being disposed between every two adjacent rollers, the three guide plates rotatably abutting against the three rollers, and being circumferentially evenly distributed along the rolling line;

a plug, the plug being disposed in a forming space formed by the three rollers and three guide plates, wherein, the forming space is cylindrical, and an axis of the plug is coincident with the rolling line; the plug is an unequal diameter rotating structure having a small end and a big end; and the small end of the plug is located in an opening of the forming space, and the opening is a feed port of the billet; and each of the three rollers comprises a first roller body and a second roller body; a big end of the first roller body is connected to a small end of the second roller body to form a roller throat; a ratio of a diameter of the roller throat to a diameter of the billet is between 1 and 3; a ratio of an axial length of the three rollers to the diameter of the roller throat is between 1.5 and 3.5; a ratio of an axial length of the first roller body to an axial length of the second roller body is 3:5; a cone angle of the three rollers is 3.5° to 5°, and a rolling angle of the three rollers is 11° to 13°.

12. The device of claim 11, wherein a joint between the first roller body and the second roller body is chamfered, with a chamfer radius of not less than 500 mm.

13. The device of claim 11, wherein the three rollers are the same in dimensions; and, the small end of the plug is disposed at the first end of the device, or the small end of the plug is disposed at the second end of the device.

14. A method for wall reduction and uniformation using the device of claim 11, the method comprising rotating the three rollers around their own axis in a revolving speed, feeding the billet from the small end to the big end of the plug into the forming space to contact the three rollers, driving the billet to move forward spirally along the rolling line to further contact the plug for wall reduction and uniformation, and outputting a final product from a gap formed by the three rollers, the three guide plates, and the plug.

15. The method of claim 14, further comprising heating the billet prior to being rolled.

* * * * *